United States Patent [19]

Rinehart

[11] 4,043,549

[45] Aug. 23, 1977

[54] IMPACT FEEDER

[75] Inventor: Stephen A. Rinehart, Penfield, N.Y.

[73] Assignee: Xerox Corporation, Stamford, Conn.

[21] Appl. No.: 634,989

[22] Filed: Nov. 24, 1975

[51] Int. Cl.[2] ..... B65H 3/06; B65H 3/48

[52] U.S. Cl. ..... 271/118; 271/120; 271/123; 271/166; 271/167

[58] Field of Search ..... 271/118, 117, 120, 119, 271/123, 121, 166, 165, 35, 98, 97, 105, 167, 195

[56] References Cited

U.S. PATENT DOCUMENTS

| | | | |
|---|---|---|---|
| 985,592 | 2/1911 | Hodgkinson | 271/120 |
| 1,071,243 | 8/1913 | Kurkiewicz | 271/118 |
| 1,262,383 | 4/1918 | Otarri et al. | 271/120 |
| 2,849,232 | 8/1958 | Halahan et al. | 271/98 |
| 3,630,516 | 12/1971 | Hong | 271/117 |
| 3,918,706 | 11/1975 | Craft | 271/195 X |
| 3,934,869 | 1/1976 | Strobel | 271/166 X |

FOREIGN PATENT DOCUMENTS

| | | | |
|---|---|---|---|
| 2,054,935 | 5/1972 | Germany | 271/118 |

*Primary Examiner*—Bruce H. Stoner, Jr.

[57] ABSTRACT

An air floatation bottom feeder employing a whip or paddle/impact feeder to positively separate single sheets from the bottom of the sheet stack and prevent multifeeds or mis-feeds, the air floatation feature being utilized to provide air bearings above and below the sheet being fed while at the same time, a portion of the air floatation jets which are canted move the bottom sheet toward side and rear registration edges for accurate positioning of the sheet.

2 Claims, 6 Drawing Figures

IMPACT FEEDER

BACKGROUND OF THE INVENTION

In modern high speed sheet processing machines such as printers, sorter, collators, reproduction machines, etc. a sheet mis-feed or multi-fed sheets can seriously impair the operation of the machine. Numerous devices such as belt feeders of the type disclosed in U.S. Pat. No. 3,768,803 or impact/paddle feeders of the type disclosed in U.S. Pat. No. 3,630,516 have been employed to minimize the possibility of mis-feeds and multi-feeds.

It is common practice to provide sheet feeding devices wherein the sheet separator is disposed at the top of the stack, a sheet elevator assembly being utilized to continuously shift the stack in an upward direction to maintain the top sheet in the stack adjacent the feed mechanism. While a bottom feed device is more convenient since the stack may be replenished without stopping machine operation and the necessity of an elevator type sheet tray is obviated, the poor paper feeding capabilities of bottom feed devices has prevented common acceptance thereof. To improve the paper feeding capabilities of bottom feeders, the air floatation principle has been employed to "lift" the stack from the bottom sheet to allow the bottom sheet in the stack to be easily separated therefrom. The air floatation feature also provides "inter-sheet" lubrication by air for ease in sheet separation.

The aforementioned impact feeders or "inertia feeders" have been employed in top sheet feed devices in an attempt to overcome inter-sheet friction and assure positive feeding of sheets by jarring or impacting the sheet to be fed, thereby breaking the inter-sheet friction between the sheet being fed and the adjacent sheets. However, in impacting the sheets, there is a tendency for the impacting device to jam the sheet to be fed into tighter engagement with the remainder of the sheets in the stack, thereby obviating the benefits obtained in attempting to impact the sheet in the feed direction, off from the remainder of the sheets in the stack.

SUMMARY OF THE INVENTION

The subject invention relates to a bottom sheet feed device employing pressurized air to reduce friction between the bottom sheet and the sheet stack tray and minimize friction between the bottom sheet and the sheet immediately adjacent thereto. An impact type feeder is employed to positively separate the bottom sheet from the stack, the impact force on the bottom sheet being absorbed by the air cushion generated between the bottom sheet and subsequent sheets in the stack, thereby preventing locking of the bottom sheet to the remainder of the sheets and allowing consistent single sheet feed.

DESCRIPTION OF THE PREFERRED EMBODIMENT

Figure 1:
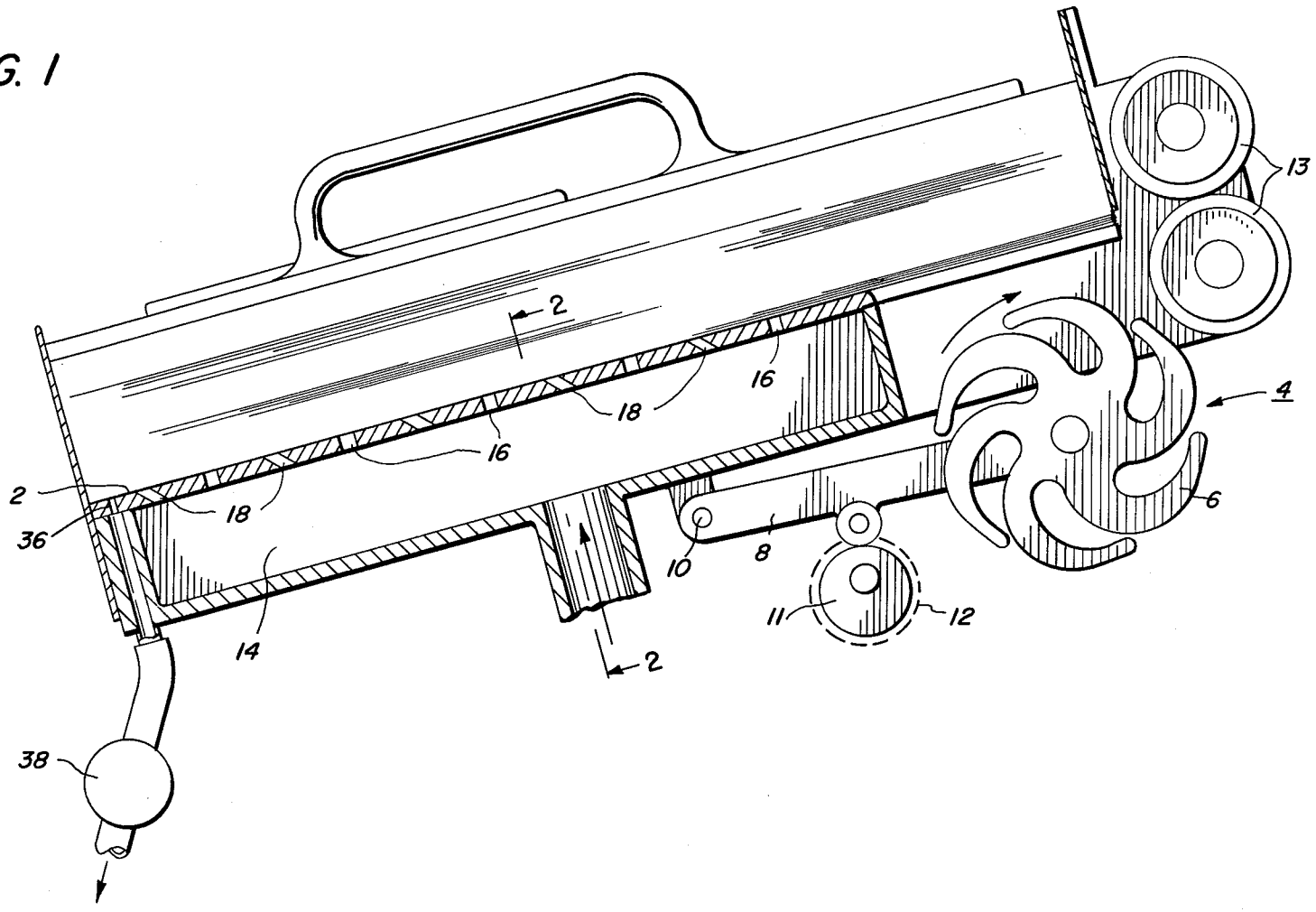
FIG. 1 is a side elevational view of the preferred embodiment of the sheet feeder forming the present invention.
Figure 2:
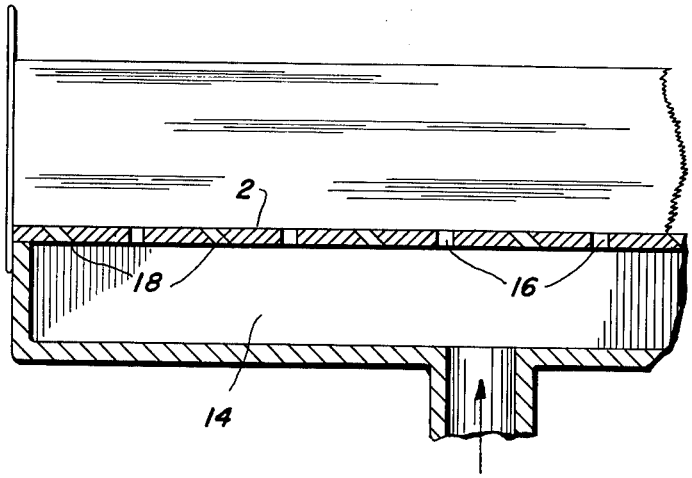
FIG. 2 is a sectional view of a portion of the sheet tray and plenum taken along line 2—2 of the sheet feeder of FIG. 1.

Referring to the drawing, the sheet feeding apparatus of the present invention includes a sheet supply tray 2 and a "whip" or impact type sheet separation apparatus 4. The sheet separation apparatus 4 as illustrated is comprised of a paddle 6 mounted on a lever arm 8, arm 8 being adapted for pivotal movement about an axis 10 by means of a cam 11 and single revolution motor or solenoid 12. The paddle 6, in the preferred embodiment, is adapted for constant rotation, actuation of single revolution motor 12 causing the paddle to be moved into engagement with the bottom sheet in the stack for movement of the sheet therefrom into the nip of take-away roller pair 13.

A plenum 14 adapted to receive pressurized fluid such as air from a suitable source (not shown) is formed beneath the bottom surface of tray assembly 2, perforations 16 being provided in tray assembly 2 for passage of the pressurized fluid therethrough. The air supplied through perforations 16 creates an air cushion between the bottom sheet of the stack and the lower surface of the tray, and between the bottom two sheets in the tray to minimize friction therebetween and aid in the removal of the sheet from the stack by the separation apparatus 4.

Angled jets 18 may be provided in tray assembly 2 for moving the bottom sheet in the stack toward the side and rear edges of the sheet tray for initial positioning of each sheet prior to the feed cycle to assure consistently accurate registration of the sheet.

Figure 3:
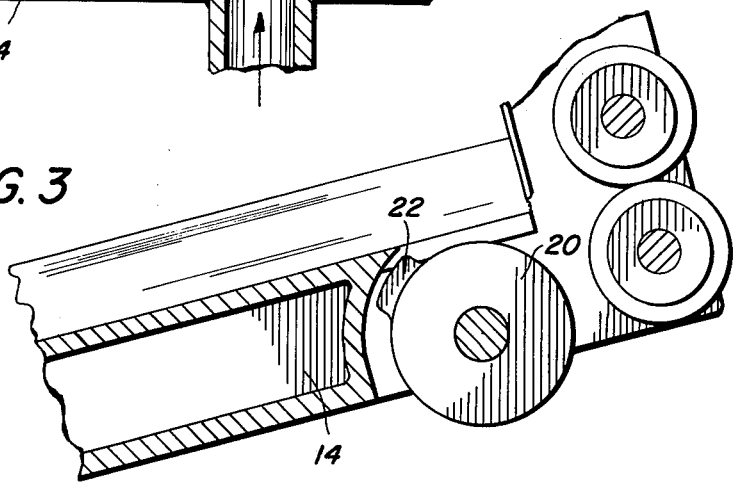
FIG. 3 is a second embodiment of an impacting member for use in the feeding device of FIG. 1.

FIG. 3 illustrates an alternative impact member comprising a disc or roll 20 having a raised friction surface 22 thereon. The impact member of FIG. 3 may be mounted on lever arm 8 in the same manner as paddle 6 and be constantly rotated for movement into and out of contact with the bottom sheet in the stack by lever 8. Alternately, the impact member of FIG. 3 could be mounted adjacent the bottom of the stack and be driven by a single revolution motor or solenoid, a suitable feed signal energizing the motor to cause the raised friction surface 22 to rotate into contact with the bottom sheet in the stack, impacting the sheet, and driving the lower sheet from tray.

Figure 4:
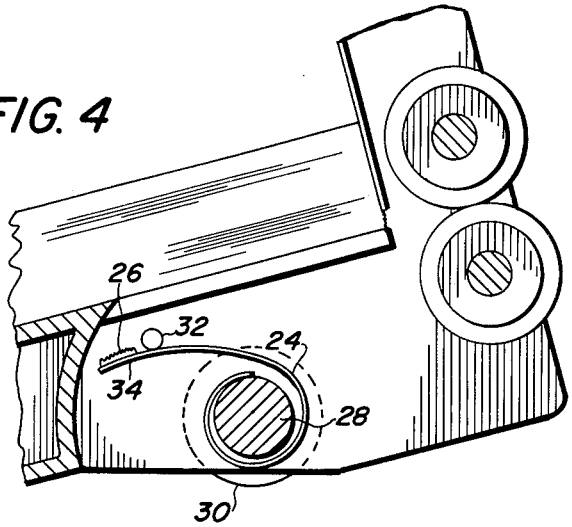
FIG. 4 is a schematic view of a third embodiment of an impact member for use in the feeding device of FIG. 1.
Figure 5:
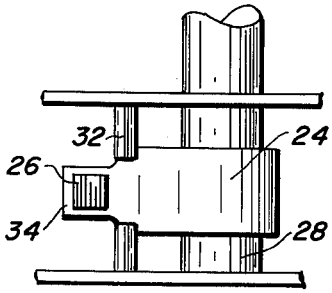
FIG. 5 is a plan view of the impacting member of FIG. 4.
Figure 6:
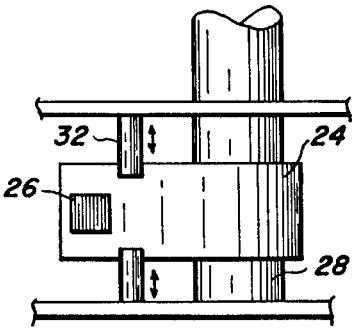
FIG. 6 is a plan view of a second embodiment of the impacting member of FIG. 4.

FIGS. 4 and 5 illustrate still another embodiment of an impact member for use with the disclosed sheet feeder. Referring to FIG. 4 there is illustrated a spring arm 24 having a friction pad 26 mounted on one end thereof. The spring member 24 is mounted on a shaft 28 adapted for movement through a single revolution by a single revolution clutch, motor or solenoid 30. Prior to a feed cycle, the spring member 24 is maintained in tension by dogs 32 which project inwardly toward the spring member 24 as best seen in FIG. 5. The end portion 34 of spring 24, upon which friction pad 26 is mounted, is reduced as seen in FIG. 5. Upon energization of the single revolution clutch or motor 30, the spring will initially wrap up about shaft 28 which increases the tension therein until the reduced portion 34 of spring 24 slips off dogs 32, at which point the spring, with the friction member thereon, will snap up against and impact the stack for feeding the sheet therefrom. While the disclosed embodiment employs stationary dogs 32, it should be understood that if desired, the spring member 24 could be full width for the entire length thereof and the dogs 32 could be adapted for movement away from the spring member 24 as illustrated by the double headed arrows in FIG. 6 to release the spring member and provide the "whip" action desired for impacting the bottom sheet in the stack.

One of the significant advantages of the impact sheet feeder with air floatation is that positive control is exercised over the inter-sheet frictional forces due to the air lubrication provided between sheets by the air floatation tray. Therefore, the problem of mechanical coupling of the sheets during impact is eliminated. Specifically this means that the driving force on the second sheet in the stack is very small since the coefficient of friction is greatly reduced. On a top feeding impact type device, the coefficient of friction between sheets, $\mu_{pp}$, typically may average 0.55. With the device disclosed, it has been found that the coefficient of friction is greatly reduced, i.e., $\mu_{pp}$ may typically average 0.02 – 0.10. Further, it has been found that with air floatation, the inter-sheet frictional coefficients are monotonically increasing, i.e., $\mu_{pp}$ between sheets 1 and 2 is less then $\mu_{pp}$ between sheets 2 and 3 is less than $\mu_{pp}$ between sheets 4 and 5 etc. For example, $\mu_{pp}$ between sheets 1 and 2 for the preferred embodiment disclosed equals approximately 0.05 while $\mu_{pp}$ between sheets 2 and 3 equals 0.10, which means that complete control of the frictional characteristics is maintained and thus, during the feed cycle of sheet 1, the paper stack will always break at the interface between sheet 1 and the next sheet since the smallest coefficient exists therebetween. This is not the case in ordinary air floatation feeding where the paper stack can break at a slippery interface higher up in the stack due to the air floatation effect without impact.

In the usual mode of operation, it is not anticipated that any multi-feeds will occur. As a consequence of the air lubrication between sheets, there exists an aerodynamic elastic foundation (i.e., air bearing) which prestiffens the bottom sheet during feeding by offering a resistive restoring force to the normal component of the impact force. The forces generated by the air bearing prevent normal deflection of the paper sheets, thereby helping to prevent mechanical coupling between sheet 1 and sheet 2 during the feed cycle. As illustrated in FIG. 1, a vacuum can be introduced through vacuum port 36 at the rear of tray assembly 2 to hold sheet 2 in place as sheet 1 is fed out. A valve 38 may be provided for controlling the valve to provide vacuum at port 36 at the instant the trailing edge of the first sheet has cleared the port.

It can be seen from the foregoing that by combining the principle of air floatation and impact feeding, the following advantages are obtained:

1. Very small driving forces are required to initiate the feed cycle for the bottom sheet in the stack;

2. As a result of the air lubrication, sheet 1 is not mechanically coupled to the sheets thereabove, resulting in a very small potential for sheet multi-feeds which can occur with the disclosed device only when there is excessive edge welding between the sheets;

3. The aerodynamic air bearing serves to pre-stiffen the sheet during contact with the impact feeder, preventing unnecessary deformations of the paper in the transfer plane (i.e., perpendicular to the plane of motion of the paper sheet);

4. The air lubrication provides the controlled inter-sheet frictional forces necessary for high reliability performance;

5. The simplified concept disclosed does not require separate retard mechanisms to prevent multi-feeds;

6. The device is capable of extremely high speed operation since impact forces can impart high acceleration to the sheets over a short distance for feeding the sheets to take-away rollers; and 7. Side registration jets may be employed to push the lowest sheet against one side wall to eliminate registration error normally encountered in sheet stacks due to slitting tolerances at the paper mill.

While the invention has been described with reference to the structure disclosed, it is not confined to the details set forth, but is intended to cover such modifications or changes as may come within the scope of the following claims.

What is claimed is:

1. A sheet feeding and separating apparatus comprising:

perforated tray means adapted to support a stack of sheets thereon;

means forming a plenum associated with said tray means, said plenum being adapted for connection to a source of pressurized air, said plenum communicating with the perforations in said tray means for passage of pressurized air from said plenum through the perforations in said tray means to provide an air bearing between said tray means and the bottom sheet in the sheet stack, and between the bottom sheet and the adjacent sheets thereabove;

impact feed means disposed adjacent the edge of said tray means;

said impact feed means comprising a leaf spring member, one end of said spring member being mounted on a rotatable shaft, the other end of said spring member having a reduced portion with a friction pad mounted thereon; and, abutment means disposed adjacent the bottom of the stack adapted for engagement with said spring member to maintain said spring member out of engagement with the bottom sheet in the stack, rotation of said rotatable shaft causing said spring member to wind therearound and move the spring member free of said abutment means, thereby allowing the end of said spring member having the friction pad thereon to impact the bottom sheet in the stack for feeding the sheet therefrom, the air bearing between the bottom sheet and the adjacent sheet thereabove cushioning the impact to prevent inter-locking of the bottom sheet and the adjacent sheet thereabove.

2. A sheet feeding and separation apparatus comprising:

perforated tray means adapted to support a stack of sheets thereon;

means forming a plenum associated with said tray means, said plenum being adapted for connection to a source of pressurized air, said plenum communicating with the perforations in said tray means for passage of pressurized air from said plenum through the perforations in said tray means to provide an air bearing between said tray means and the bottom sheet in the sheet stack, and between the bottom sheet and the adjacent sheets thereabove;

impact feed means disposed adjacent the edge of said tray means;

said impact feed means comprising a leaf spring member, one end of said leaf spring being mounted on a rotatable shaft, the other end of said spring member having a friction pad mounted thereon; and, movable abutment means adapted to maintain said spring member out of contact with the bottom sheet in the stack, movement of said abutment means out of engagement with said spring when said rotatable shaft is rotated allowing said springs means to "whip" into engagement with the bottom sheet in the stack for movement of the sheet therefrom, the air bearing between the bottom sheet and the adjacent sheet thereabove cushioning the impact to prevent inter-locking of the bottom sheet and the adjacent sheet thereabove.

* * * * *